US007703466B1

(12) United States Patent
Smith

(10) Patent No.: US 7,703,466 B1
(45) Date of Patent: Apr. 27, 2010

(54) MOUNTING ASSEMBLY

(76) Inventor: Mark Smith, 3110 Lynnwood Way, Louisville, KY (US) 40299

( * ) Notice: Subject to any disclaimer, the term of this patent is extended or adjusted under 35 U.S.C. 154(b) by 348 days.

(21) Appl. No.: 11/739,153

(22) Filed: Apr. 24, 2007

(51) Int. Cl.
*E04H 15/10* (2006.01)
*B42F 13/00* (2006.01)

(52) U.S. Cl. ..... 135/91; 135/96; 135/135; 248/343; 248/317; 362/396; 362/404

(58) Field of Classification Search ..... 135/91–94, 135/96, 135, 147, 120.1; 248/342–343, 229.2, 248/317, 339–340; 362/145–148, 150, 396, 362/404, 406, 450
See application file for complete search history.

(56) References Cited

U.S. PATENT DOCUMENTS

| | | | | |
|---|---|---|---|---|
| 353,168 | A | 11/1886 | Shaw | |
| 493,305 | A * | 3/1893 | Sherman | 416/246 |
| 1,264,078 | A * | 4/1918 | Jaureguy | 135/126 |
| 1,698,328 | A * | 1/1929 | Duffie | 248/606 |
| 2,088,812 | A * | 8/1937 | Reichenbach | 248/682 |
| 2,314,830 | A | 3/1943 | Hunter | |
| 2,466,496 | A | 4/1949 | Smith | |
| 4,041,657 | A * | 8/1977 | Schuplin | 52/39 |
| 5,033,489 | A * | 7/1991 | Ferre et al. | 134/57 R |
| 5,183,233 | A | 2/1993 | LaPalomento | |
| 5,567,117 | A | 10/1996 | Gunn et al. | |
| 5,845,886 | A * | 12/1998 | McCormick | 248/200.1 |
| 6,119,408 | A | 9/2000 | Page | |
| 6,168,298 | B1 * | 1/2001 | Hentz et al. | 362/365 |
| 6,286,265 | B1 * | 9/2001 | Rinderer | 52/28 |
| 6,345,800 | B1 * | 2/2002 | Herst et al. | 248/342 |
| 6,397,869 | B1 | 6/2002 | Jennings | |
| 6,401,806 | B1 | 6/2002 | Lee et al. | |
| 6,516,823 | B1 * | 2/2003 | Glover et al. | 135/94 |
| 6,742,309 | B2 * | 6/2004 | Stewart et al. | 52/79.5 |
| 6,858,054 | B2 | 2/2005 | Page | |
| 6,932,578 | B2 | 8/2005 | Pearce | |
| 6,944,995 | B2 | 9/2005 | Duffey et al. | |
| 7,451,776 | B2 * | 11/2008 | Chen | 135/147 |
| 2003/0037812 | A1 | 2/2003 | Stewart et al. | |
| 2004/0165990 | A1 | 8/2004 | Lee | |
| 2007/0209694 | A1 * | 9/2007 | Gooch et al. | 135/91 |

FOREIGN PATENT DOCUMENTS

| | | |
|---|---|---|
| JP | 62294832 | 12/1987 |
| WO | WO 2007038751 A2 * | 4/2007 |

* cited by examiner

*Primary Examiner*—Winnie Yip
(74) *Attorney, Agent, or Firm*—James E. Cole; Middleton Reutlinger

(57) ABSTRACT

A furniture joinery comprises a slide rail having a plurality of grooves, at least one slide block slidably disposed in the slide rail, the slide block having a plurality of slides for engaging the slide rail, at least one of the plurality of slides having a neck and a head, the grooves receiving the neck therein.

18 Claims, 8 Drawing Sheets

MOUNTING ASSEMBLY

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates to a mounting assembly and more particularly to mounting assembly for use in a tent, for example, which is used during tailgating activities.

2. Description of the Related Art

Portable tents are utilized for various events such as tailgating and wedding receptions, outdoor dining and the like. At times, during unexpectedly hot weather, tents can become extremely warm rendering users therein uncomfortable. In order to alleviate this problem, it is preferable that, where the tent is tall enough to accommodate such device, a ceiling fan be used to move air within the tent. However, tents come in various sizes and shapes so mounting these air movers is difficult.

Likewise, lighting is sometimes a problem inside tents. A mounting assembly for positioning a luminaire is desirable, in addition to or independently of the fan assembly as described above.

Given the foregoing, it will be appreciated that a tent canopy mounting assembly is desired which may be used with various tent constructions and which allows for easy installations of suspended electrical equipment and which allows for connection of a power supply to operate the electrical equipment.

SUMMARY OF THE INVENTION

A tent canopy mounting assembly comprises a body, a first mounting bar, a second mounting bar disposed opposite the first mounting assembly, the first and second mounting bars each pivotally connected to the body. The first mounting bar and the second mounting bar each including at least one finger for capturing a tent canopy structure. The first and second mounting assemblies each having mounting blocks connected to the body. The mounting blocks pivotably connecting the first and second mounting bars to the body. The first and second mounting bars are substantially T-shaped. The body is a planar structure. The tent canopy mounting assembly further comprises a cord and electrical connector in electrical communication with a junction box. The tent canopy mounting assembly further comprises a ceiling fan depending from the body and in electrical communication with the cord and the electrical connector. The tent canopy mounting assembly further comprises a light depending from the body and in electrical communication with the electrical connection.

A tent canopy mounting assembly comprises a first substantially T-shaped hanger bar, a second substantially T-shaped hanger bar opposite the first hanger bar, at least one first mounting block, the first hanger bar pivotally connected to the at least one first mounting block, at least one second mounting block, the second hanger bar pivotally connected to the at least one second mounting block, a planar body, the at least one first mounting block and the at least one second mounting block disposed on the planar body. The at least one first mounting block being two opposed mounting blocks. The at least one second mounting block being two opposed mounting blocks. The tent canopy mounting assembly further comprises at least one finger disposed at an end of the hanger bar. The at least one finger being two fingers.

A mounting assembly for a tent canopy, comprises a tent having a canopy structure, a first hanger bar depending from the canopy structure pivotally connected to at least one mounting block, a second hanger bar depending from the canopy structure pivotally connected to an opposed at least one mounting block, each of the at least one mounting blocks positioned on a body; and, a fan connected to the body. The mounting assembly for a tent canopy further comprises a power cord extending from the mounting assembly and in electrical communication with the fan. The mounting assembly for a tent canopy further comprises a rectifier and a battery in electrical communication with the power cord and the fan. The fan is powered by AC and DC power. The mounting assembly for a tent canopy further comprises fingers depending from ends the first hanger bar and the second hanger bar.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
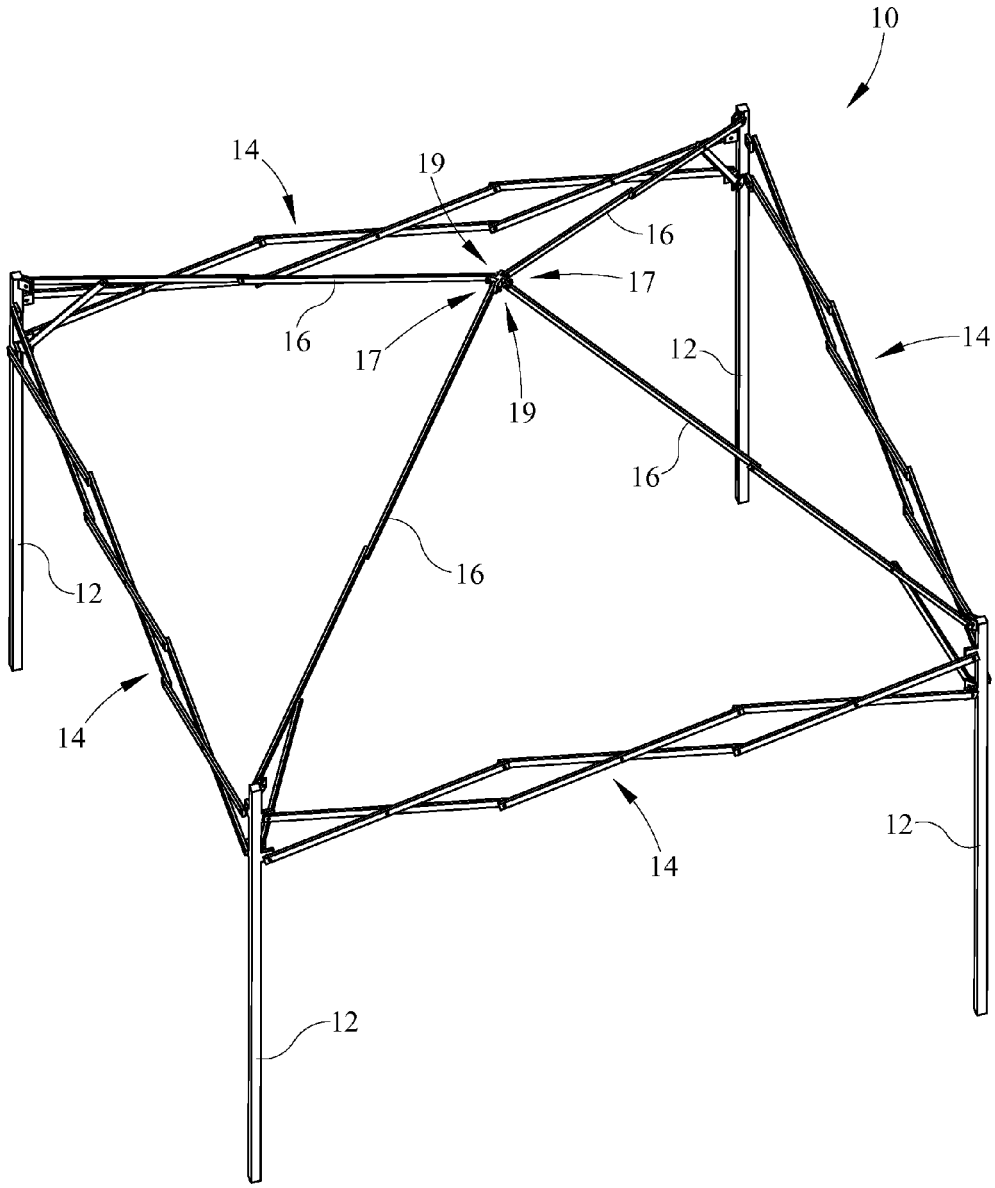
FIG. 1 depicts a perspective view of a foldable tent frame.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted,"

and variations thereof herein are used broadly and encompass direct and indirect connections, couplings, and mountings. In addition, the terms "connected" and "coupled" and variations thereof are not restricted to physical or mechanical connections or couplings.

Referring to FIG. 1, a perspective view of a tent 10 is depicted. The exemplary tent 10 comprises a frame defined by four vertical legs 12 positioned at corners of the tent 10. The present embodiment depicts four vertical legs or posts 12 however, for larger tents, additional posts may be utilized to cover larger areas and may therefore are considered to be usable with the mounting assembly. The vertical posts 12 are depicted as being square in shape however, it should be understood that the posts 12 may have a circular cross-section or alternative structural shapes which are known to one skilled in the art for structural design.

The tent frame further comprises horizontal support structures 14 extending between the vertical posts 12. The exemplary horizontal support structures 14 are foldable truss designs which allow the tent 10 to be folded into a storable size without disconnecting all of the parts forming the tent 10. Thus, erection of the tent 10 is fast and easy, however, it is should be understood that the tent 10 need not be foldable, but instead may have a rigid design. Thus, the horizontal supports 14 and/or the vertical posts 12 may alternatively comprise rigid structures, such as channels, square or round posts or the like.

Extending from the upper portions of the vertical posts 10 are tent top structures 16 which define a square pyramidal shape for the canopy or top of the tent 10. Although the exemplary tent canopy is square pyramidal in shape, the shape should not be considered limiting as other shapes may be utilized which work with the canopy mount described further herein.

The tent top structures 16 are pivotally connected to the vertical posts 12 at one end and to a top adapter allowing pivotal motion of each tent top structure 16 to define the square pyramidal top design of tent 10. Between adjacent tent top structures 16, a first support area 17 is defined. Spaced 180 degrees from the first support area 17 is another support area 17. Likewise, positioned between the first support areas 17, spaced 90 degrees therefrom, are second support areas 19 also defined between adjacent tent top structures 16. The support areas 17,19 are generally triangular in shape however the shape may vary with the shape of the canopy, as previously described. The tent top structures 16 are generally depicted as pivotally connected however, as previously indicated, the tent 10 need not be foldable but instead, the frame may be rigid. It should, therefore be understood by one skilled in the art that the present tent design 10 should not be considered as limiting and other tent frame structures may be utilized and may be considered to be within the scope of the present invention.

The tent 10 is shown without fabric on the canopy or extending between the vertical posts 12. The tent 10 may have fabric extending between the tent top structures 16 to define the pyramidal top area and may or may not have fabric extending between the vertical posts 12 to enclose the tent 10. The tent 10 may be used for various occasions such as tailgating, wedding receptions, outdoor parties or the like where the tent fabric extending between the vertical posts 12 may or may not be desired. However, the tent 10 should not be limited to one of the structures having the fabric or not having the fabric extending between the vertical posts 12 as either structure is considered to be a useable construction.

Figure 2:
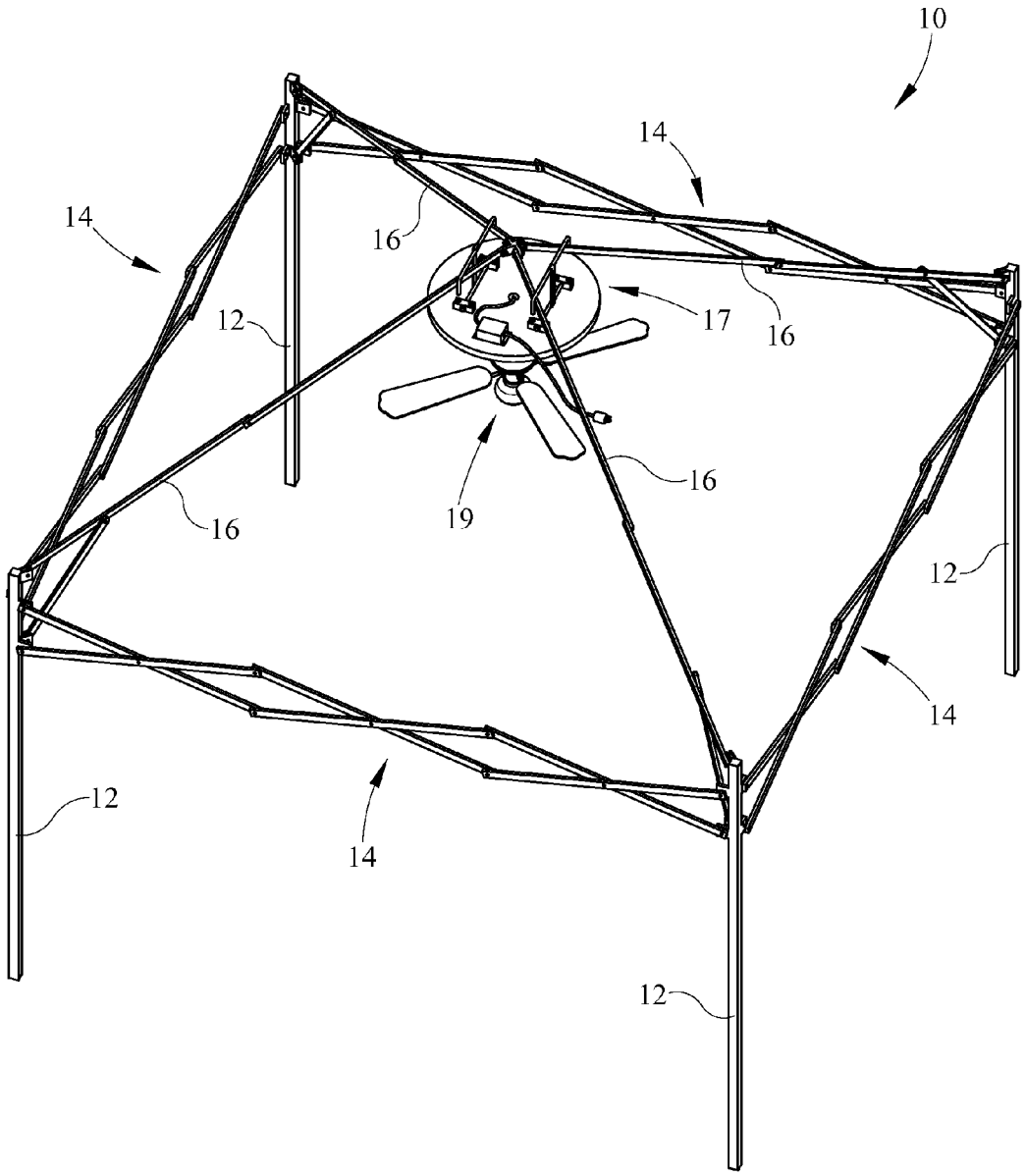
FIG. 2 depicts a perspective view of the foldable tent frame of FIG. 1 with a tent canopy mounting assembly.

Referring now to FIG. 2, a perspective view is depicted of the tent 10 of FIG. 1 and further comprising a canopy mounting assembly 20 having a fan 22 depending therefrom. The canopy mounting assembly 20 is suspended from the tent canopy so that a fan 22, a light or other electrical device may be safely positioned within the tent for use by those within the tent structure. The tent canopy mounting assembly 20 is shown positioned within opposed first support areas 17 however, the mounting assembly 20 may alternatively be positioned in the second support areas 19 by generally rotating the assembly 20 about 90 degrees.

Figure 3:
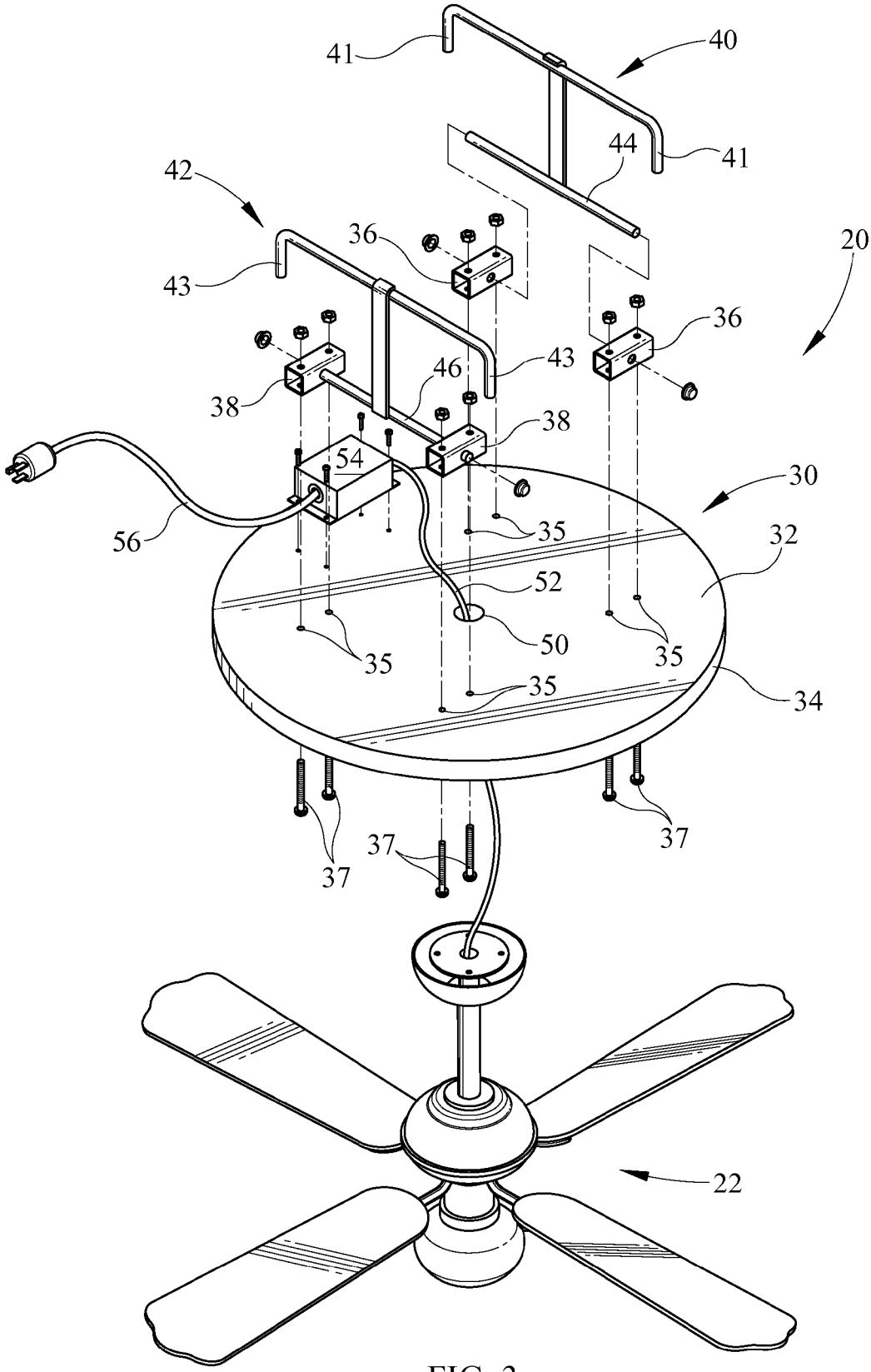
FIG. 3 depicts an exploded view of the tent canopy mounting assembly and an exemplary fan.
Figure 8:
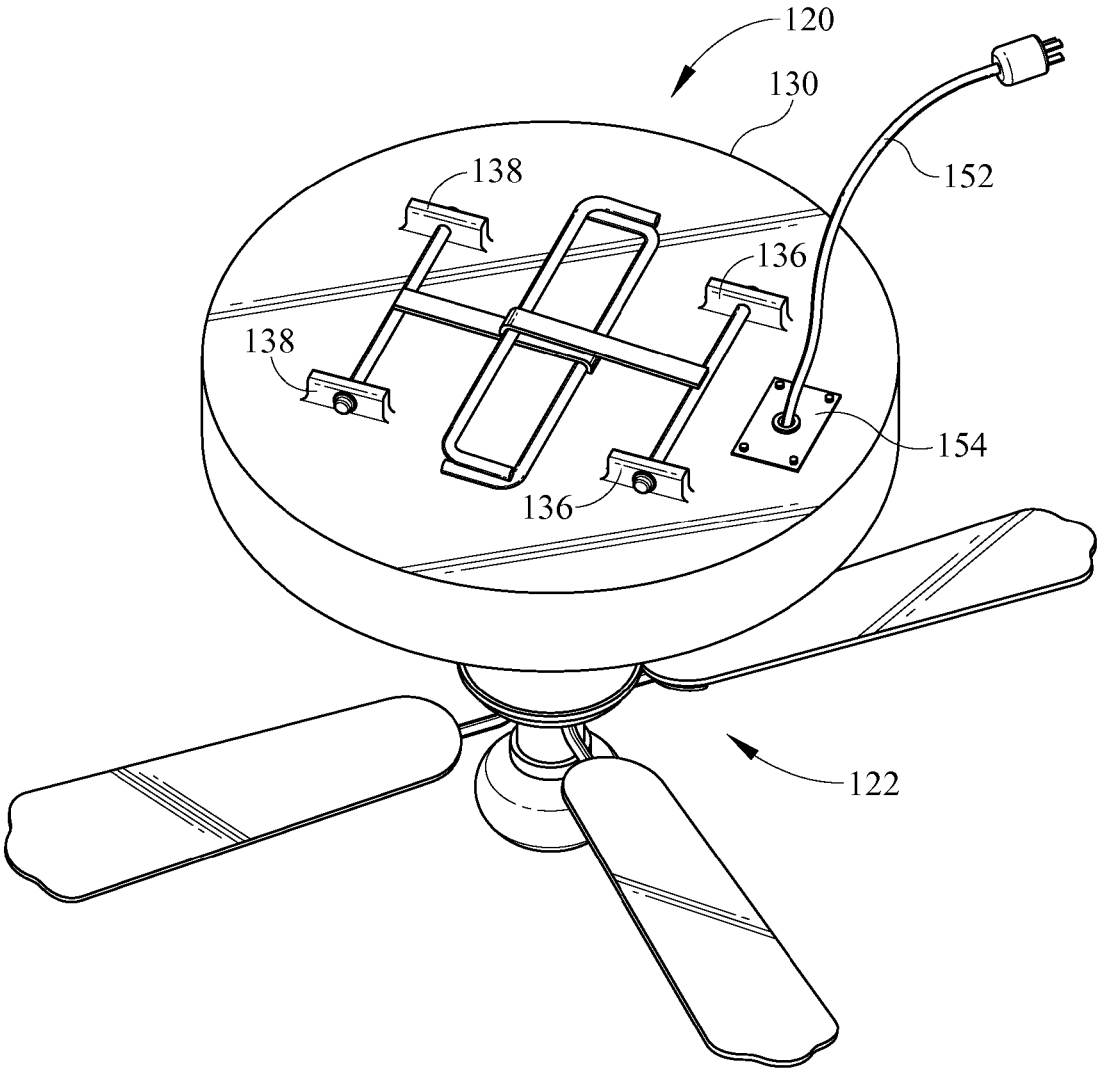

Referring now to FIG. 3, the canopy mounting assembly 20 and fan 22 are depicted in exploded perspective view. The canopy mounting assembly 20 comprises a body 30 having an upper surface 32 and a peripheral edge 34. The body 30 is depicted as being circular in shape however, such shape is merely exemplary and should not be considered limiting as alternative shapes may be utilized. The body 30 may be solid or hollow and has a plurality of apertures 35 for connection of additional structure described further herein. Disposed above the body 30 is a first mounting or hanger bar 40. The mounting bar 40 further comprises a pivoting bar 44 extending between opposed first blocks 36. The first blocks 36 are fastened to the body 30 by utilizing the fastening apertures 35 and fasteners 37, however, as shown in FIG. 8 the mounting blocks may be integrally formed in the body 30. The first mounting blocks 36 each comprise an aperture for receiving the pivoting bar 44. The mounting bar 40 is generally T-shaped and connected to the pivoting bar 44. The ends of the mounting bar 40 comprise fingers 41 to engage the tent top structures 16 and retain the mounting bar 40 in position within the first support area 17 or the second support area 19 depending on the mounting orientation. Since the tent top structures 16 angle from a top downwardly to a wider spacing at the posts 12, the mounting bar 40 will find a neutral position where the fingers 43 engage the structures 16. The mounting bar 40 and fingers 41 are depicted as having a circular cross-section however, alternative structural shapes may be used, such as square, triangular, channel or the like. Further, the mounting bar 40 may have alternate shapes, other than T-shaped, for example the lower portion of the bar 40 may comprise more than one bar and may not be perpendicular to the upper portion having the fingers 41.

The body 30 further comprises second opposed mounting blocks 38 positioned on the upper surface 32 and receiving fasteners 37 which extend through the apertures 35 in the body 30. The second mounting or hanger bar 42 further comprises a pivoting bar 46 which is shown extending through the mounting blocks 38 for pivotal motion relative to the body 30 and blocks 38 fastened thereto. The mounting or hanger bar 42 is substantially T-shaped with fingers 43 depending therefrom. Like mounting bar 40 and fingers 41, the mounting bar 42 and fingers 43 are depicted as being generally circular in cross-section however alternative structural shapes may be utilized which allow for pivotal motion of the bars 40 and 42 relative to the body 30. The fingers 43 extend over the tent top structures 16 opposite mounting bar 40. Like mounting bars 40, the fingers 43 will seek a neutral position where the top structures 16 are engaged. According to an alternative embodiment, the blocks 36,38 may be formed integrally with the body 30. In such embodiment, the blocks 36,38 would extend upwardly, at least in part, above the upper surface of the body 30 so that apertures for the pivot bars 44,46 are exposed. This allows pivoting motion of the bars 44,46. Also, in either embodiment, the bars 44,46 may be stationary relative to blocks 36,38, and the bars 36,38 may include a pivot bearing or the like located between the pivot bar 44 or 46 and the remaining portions mounting bar 40, 42.

The body 30 further comprises a central aperture 50 through which a wire or conduit providing electrical communication with the fan 22 may extend. The fan 22 is connected to the body 30 by fasteners or other known structure (not shown). On the upper surface of the body 30 is a junction box 54. The conduit or wire 52 extending from the fan 22 extends into the junction box 54 wherein wire connections are made. Extending from the junction box 54 is a second conduit or wire 56 which may be connected to a power supply (not shown). The junction box 54 is depicted as being fastened to the body 30 however, as shown in FIG. 8 the junction box 54 may be formed integrally with the body 30 so that the junction box 54 is flush with the upper surface of the junction box 54 or so that it integrally extends from the upper surface of the body 30.

Figure 4:
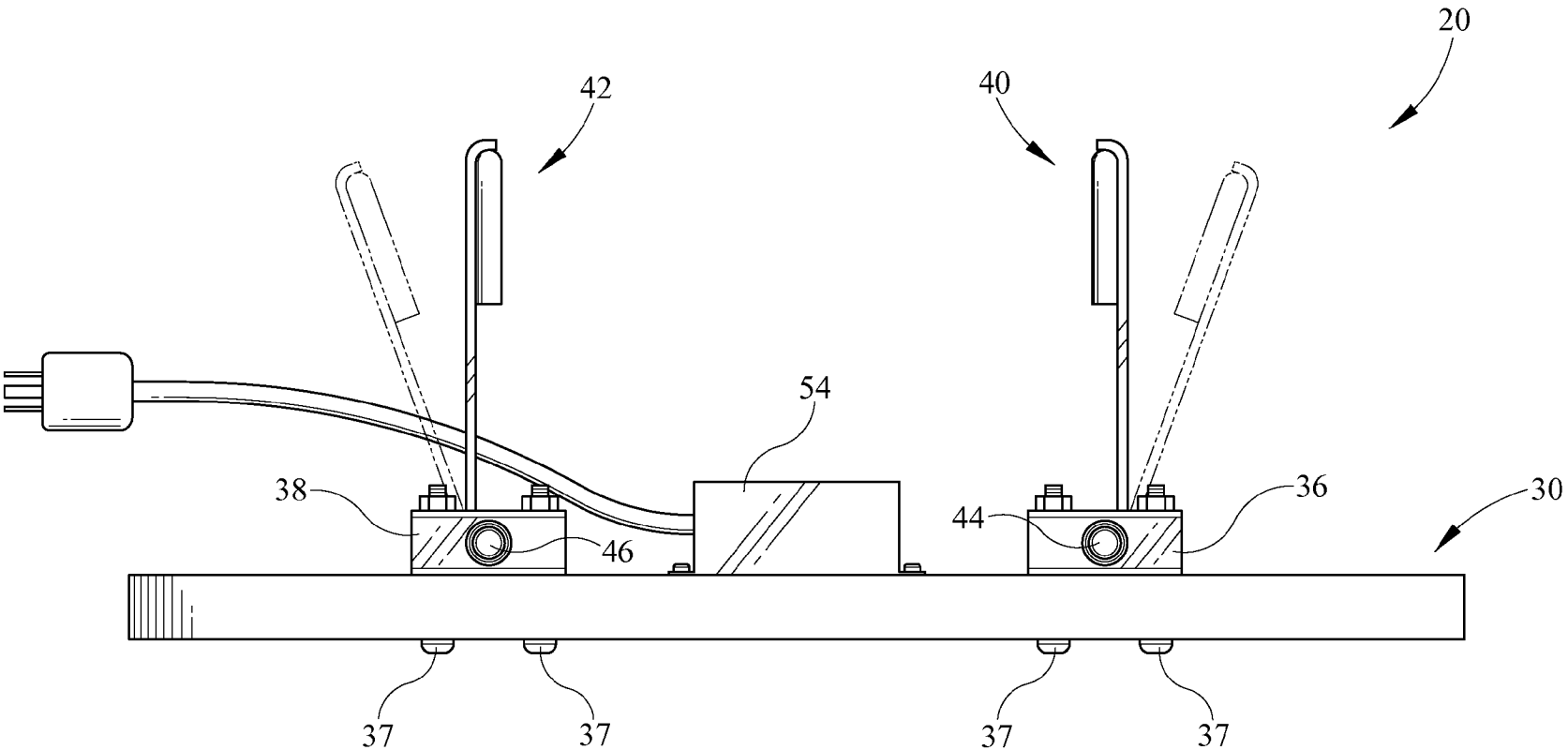
FIG. 4 depicts a side view of the tent canopy mounting assembly with the pivotable mounting bars.

Referring now to FIG. 4, a side view of the canopy mounting assembly 20 is depicted. The body 30 is shown connected to the blocks 36, 38 wherein pivot bars 44 and 46 are located respectively. In this assembled condition, the mounting bars 40, 42 are pivotally movable through an arc of about 180 degrees. The pivotal motion of the mounting bars 40, 42 allows the canopy mounting assembly 20 to be positioned between tent top structures 16 having various degrees of angular spacing within the first support area 17 or second support area 19. In addition to this pivoting feature, the fingers 41, 43 at distal ends of the mounting bars 40, 42 capture the tent top structures 16 to retain the mounting canopy 20 regardless of the angular spacing between the tent top structures 16 and regardless of the angle of the tent top structures 16 from the tent top to the posts 12.

Figure 5:
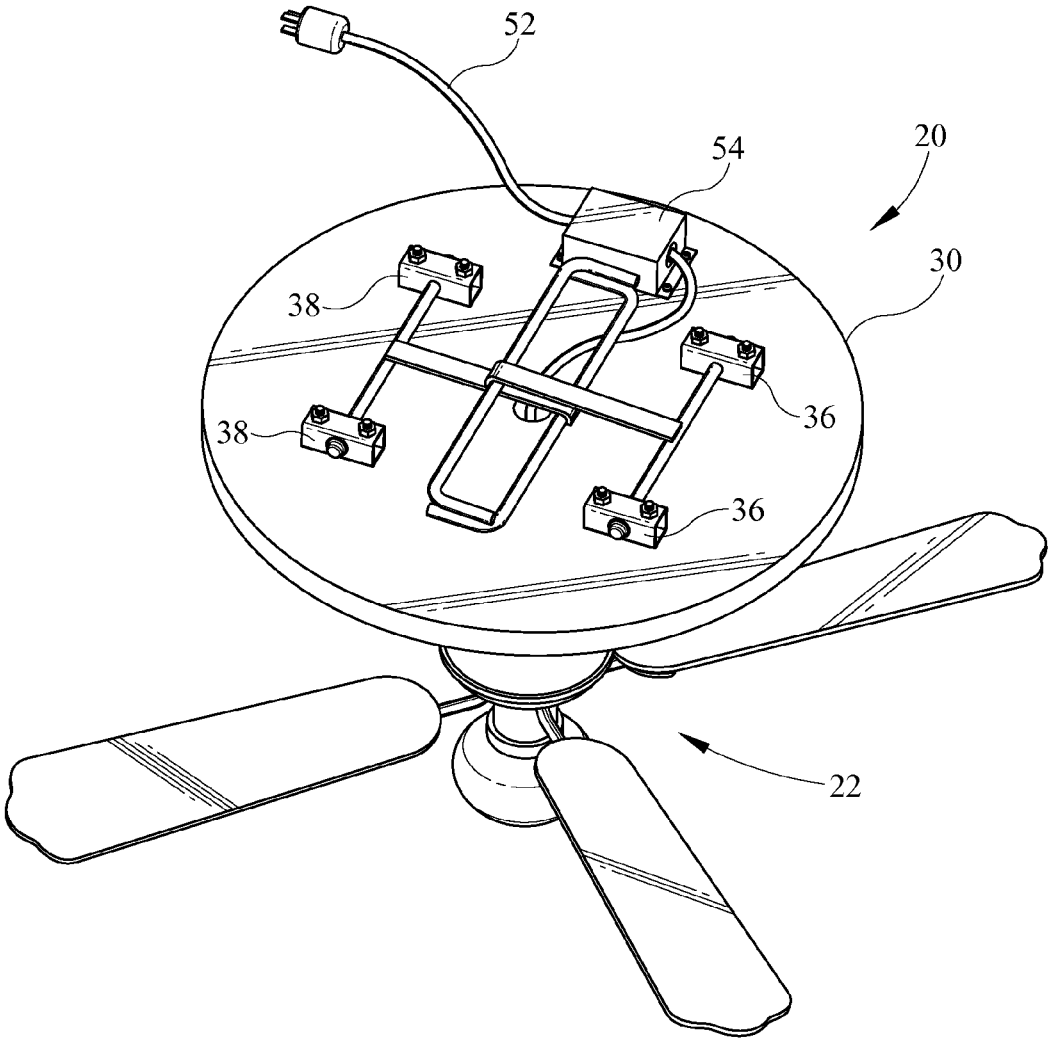
FIG. 5 depicts a top perspective view of the tent canopy mounting assembly and fan, with pivotable mounting bars in a downward position.

Referring to FIG. 5, the tent canopy mounting assembly 20 is shown connected to the fan 22. The mounting arms 40, 42 are pivoted downwardly to depict the range of motion of the mounting arms 40, 42 in one direction. The configuration of the assembly 20 provides a low profile preferable for shipping.

Figure 6:
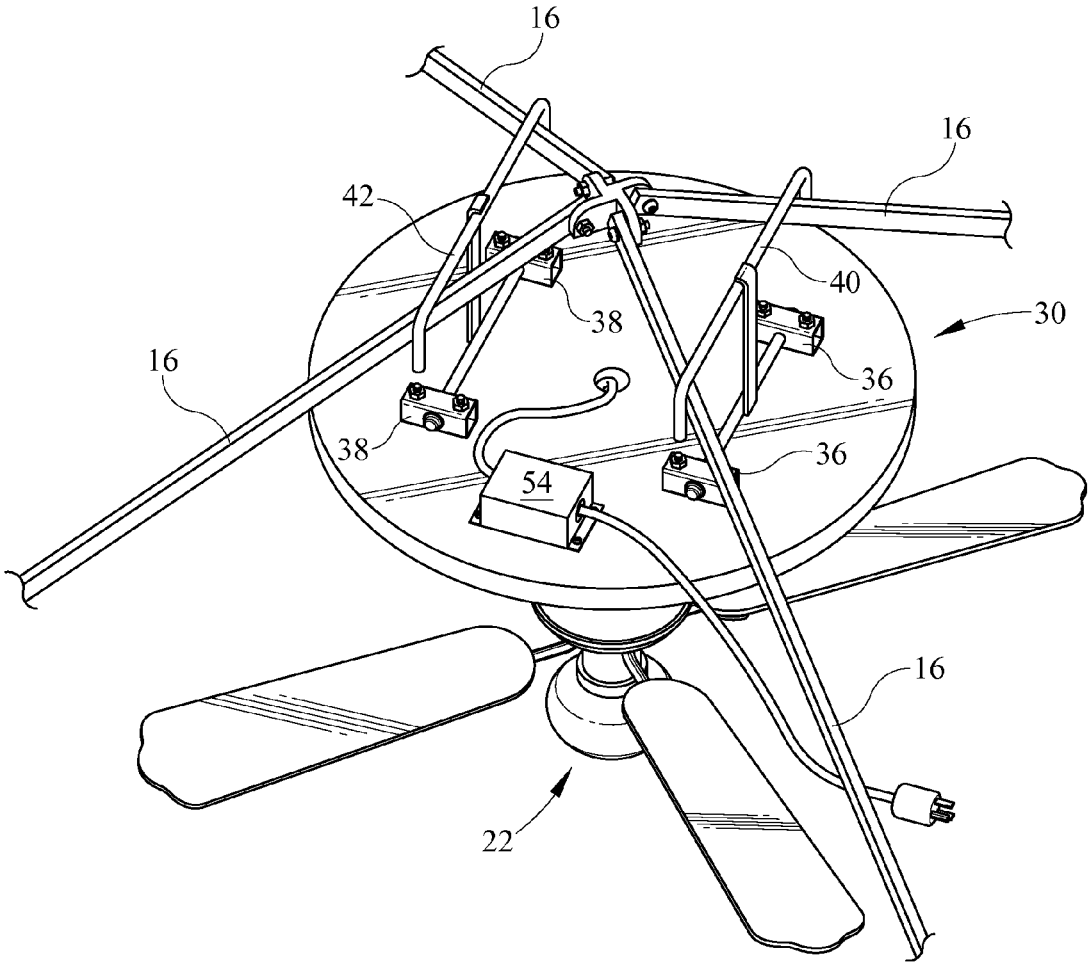
FIG. 6 depicts a top perspective view of the tent canopy mounting assembly suspended from the tent canopy structure.

Referring to FIG. 6, a top perspective view of the tent canopy mounting assembly 20 is depicted including the fan 22. The tent top structures 16 are also depicted such that the mounting bars 40, 42 are pivoted upwardly. In this position, the tent canopy mounting assembly 20 may depend from the tent top canopy structure 16 such that the fan 22 may be operated within the tent 10 during tailgating activities or the like. It should be understood that various electrical devices may be utilized with the assembly 20, instead of fan 22. For example, a light assembly may be suspended from the canopy structures 16 or other such devices.

In order to install the tent canopy mounting assembly 20, one of the mounting bars 40, 42 is folded upwardly into the position depicted in FIG. 6 while the other remains folded down in the position shown in FIG. 5. The upwardly extending mounting bar 40 depends from the tent top mounting structure 16 so that the fingers capture two of the tent top structures 16. With the opposite side of the body 30 pushed upwardly toward the mounting structures 16, the second mounting bar 42 is folded upwardly over the two remaining tent top structures 16 so as to engage the fingers. After this is completed, the mounting bars 40, 42 depend from the tent top structure first support area 17. The same process may be utilized in order to connect the canopy mounting assembly 20 within the second support areas 19. In order to do so however, the mounting assembly 20 should be rotated 90 degrees about a vertical axis before connecting the mounting bars 40, 42.

Figure 7:
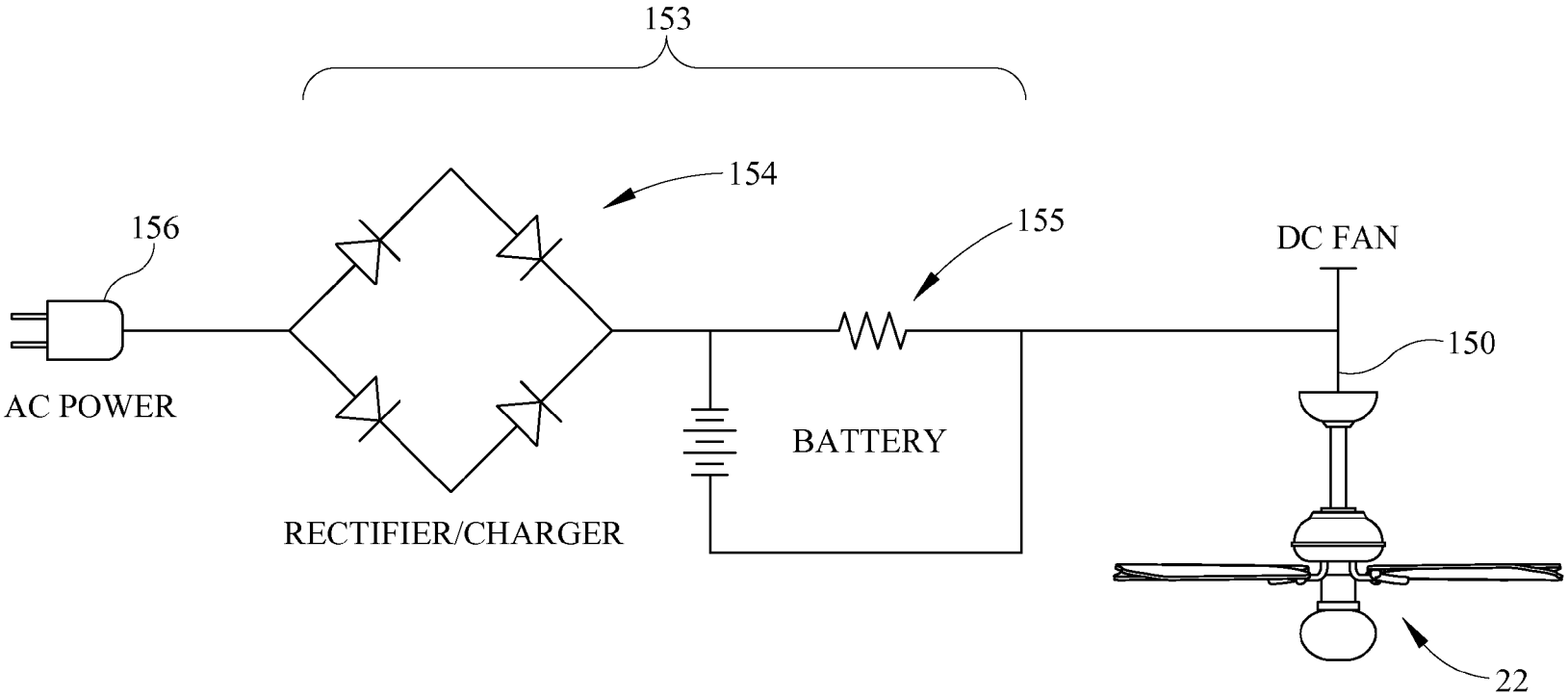
FIG. 7 depicts a schematic view of a power system utilizing AC and DC power with the tent canopy mounting assembly; and, FIG. 8 depicts a perspective view of an alternative design.

Referring now to FIG. 7, a schematic view of an alternative power supply system is depicted. The structures shown in the schematic view may be formed in an assembly and connected to the mounting assembly 20. The first embodiment utilized an alternating current (AC) power system which had to be connected to an AC power source via an extension cord 56 extending from the junction box 54. However, at locations where the tent 10 and canopy mounting assembly 20 are utilized, AC power may not be available. Accordingly, the structures depicted in FIG. 7 allow for the use of alternating current or direct current (DC) so that the exemplary fan 22 may be utilized where an AC power supply is not available. The schematic figure depicts an AC plug 156 which may be utilized to power the fan 22 or to charge a DC power circuit. The DC power circuit 153 comprises a rectifier/charger 154 and a battery 155. The AC power supply 156 provides AC power to the rectifier/charger 154. The AC power is converted to DC power and directed to the battery 155 in electrical communication therewith. The battery 155 charges and is in electrical communication via the power cord 150 with the fan 22. When the AC power 156 is removed from the system, the fan 22 will run from the power stored in the battery 155. However, if the AC power is available 156, the fan 22 will run from the AC power which is converted through the DC power circuit 153. This circuitry may be installed on the upper portion of the mounting assembly 20 cleared of the pivotal mounting bars 40, 42.

Referring now to FIG. 8, an alternative mounting assembly 120 is shown. The alternative assembly 120 has a body 130 having a height or thickness dimension which is greater than body 20. The body 130 may by partially or completely hollow. The increased height provides a location for positioning of a junction box 154 integrally within the body 130. The junction box 154 may further include a removable door or plate which allows for access within the junction box 154. Due to the hollow design of the body 130, the embodiment may comprise a battery and charging system as show in FIG. 7 positioned in the interior portion of the body 130. The body 130 also comprises mounting blocks 136 and 138 integrally formed therein. The integral construction of the junction box 154 and the mounting blocks 136 and 138 allows the body 130 to be formed of a lightweight impact-resistant moldable material. This design costs less to manufacture and is lightweight, a desirable characteristic for a hanging assembly. A fan 122 is depending from the body 130 but may include alternative components such as a light or other electrical equipment desirable for use in a tent.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A tent canopy mounting assembly, comprising:

a generally planar body including an upper substantially planar surface and a lower substantially planar surface, said body having a fan mounted to said lower surface of said body;

a first mounting bar;

a second mounting bar disposed opposite said first mounting bar;

said first and second mounting bars each pivotally connected to said upper substantially planar surface of said body;

said mounting assembly having a first folding position wherein said first mounting bar and said second mounting bar are pivoted toward said body, said assembly having a second opening position wherein said first mounting bar and said second mounting bar are pivoted to a second position pivoted away from said body, said first mounting bar and said second mounting bar each including at least one finger extending at an angle to each of said first and second mounting bars for capturing a support structure of a tent canopy;

said first and second mounting bars disposed in said second opening position for hanging from the support structure of a tent canopy.

2. The tent canopy of claim 1, said first and second mounting bars each having mounting blocks connected to said body.

3. The tent canopy of claim 2, said mounting blocks pivotably connecting said first and second mounting bars to said body.

4. The tent canopy mounting assembly of claim 3, said first and second mounting bars being substantially T-shaped.

5. The tent canopy mounting assembly of claim 1 further comprising a cord and electrical connector in electrical communication with a junction box.

6. The tent canopy mounting assembly of claim 5 wherein said fan being a ceiling fan depending from said body and in electrical communication with said cord and said electrical connector.

7. The tent canopy mounting assembly of claim 5 further comprising a light depending from said body and in electrical communication with said electrical connector.

8. A tent canopy mounting assembly, comprising:

a first substantially T-shaped hanger bar;

a second substantially T-shaped hanger bar disposed opposite said first hanger bar;

at least one first mounting block, said first hanger bar pivotally connected to said at least one first mounting block;

at least one second mounting block, said second hanger bar pivotally connected to said at least one second mounting block;

a body having an upper planar surface and a lower planar surface, said at least one first mounting block and said at least one second mounting block mounted on said upper surface of said planar body;

said first hanger bar and said second hanger bar each having a first folding position pivoted downwardly adjacent said planar body and a second opening position pivoted upwardly from said planar body to hang from an interior of a tent canopy structure.

9. The tent canopy mounting assembly of claim 8, said at least one first mounting block being two opposed mounting blocks.

10. The tent canopy mounting assembly of claim 9, said at least one second mounting block being two opposed mounting blocks.

11. The tent canopy mounting assembly of claim 8 further comprising at least one finger disposed at an end of said first and second hanger bars.

12. The tent canopy mounting assembly of claim 11, said at least one finger being two fingers.

13. A mounting assembly for a tent canopy, comprising:

a tent having a canopy structure;

a first hanger bar depending from said canopy structure pivotally connected to at least one mounting block;

a second hanger bar depending from said canopy structure pivotally connected to an opposed at least one mounting block;

each of said at least one mounting blocks positioned on a body having a first planar surface and a second planar surface, said mounting blocks both mounted on one of said first and second planar surfaces;

said first hanger bar and said second hanger bar pivotable within said mounting blocks from a first folded position adjacent said body to a second opening position pivoted away from said body and connected to said tent canopy structure;

a fan connected to said body on the other of said first and second planar surfaces.

14. The mounting assembly for a tent canopy of claim 13 further comprising a power cord extending from said body and in electrical communication with said fan.

15. The mounting assembly for a tent canopy of claim 14 further comprising a rectifier and a battery in electrical communication with said power cord and said fan.

16. The mounting assembly for a tent canopy of claim 14, said fan being powered by AC and DC power.

17. The mounting assembly for a tent canopy of claim 13 further comprising fingers depending from ends said first hanger bar and said second hanger bar.

18. The mounting assembly for a tent canopy of claim 13, said body having an aperture for an electrical cord to pass through.

* * * * *